US009878459B2

(12) United States Patent
Lee

(10) Patent No.: US 9,878,459 B2
(45) Date of Patent: Jan. 30, 2018

(54) PUNCHING APPARATUS FOR WIRE-BINDING BOOK

(71) Applicant: SHIN HEUNG MACHINERY CO., Gyeonggi-do (KR)

(72) Inventor: Sin-Young Lee, Gyeonggi-do (KR)

(73) Assignee: SHIN HEUNG MACHINERY CO., Gyeonggi-Do (KR)

( * ) Notice: Subject to any disclaimer, the term of this patent is extended or adjusted under 35 U.S.C. 154(b) by 0 days.

(21) Appl. No.: 15/129,825

(22) PCT Filed: Jul. 3, 2015

(86) PCT No.: PCT/KR2015/006895
§ 371 (c)(1),
(2) Date: Sep. 27, 2016

(87) PCT Pub. No.: WO2016/006880
PCT Pub. Date: Jan. 14, 2016

(65) Prior Publication Data

US 2017/0173811 A1 Jun. 22, 2017

(30) Foreign Application Priority Data

Jul. 9, 2014 (KR) ..... 10-2014-0086110

(51) Int. Cl.
*B26D 7/01* (2006.01)
*B26F 1/24* (2006.01)
(Continued)

(52) U.S. Cl.
CPC ..... *B26D 7/015* (2013.01); *B26F 1/24* (2013.01); *B42B 5/12* (2013.01); *B65H 5/16* (2013.01)

(58) Field of Classification Search
CPC .. B26D 7/015; B65H 5/16; B26F 1/24; B42B 5/12
See application file for complete search history.

(56) References Cited

U.S. PATENT DOCUMENTS 4,030,390 A * 6/1977 Heiting ..... B26D 7/015 83/123
4,509,397 A * 4/1985 Mori ..... B26D 7/015 83/33

(Continued)

FOREIGN PATENT DOCUMENTS

KR 20-0303044 2/2003
KR 10-2005-0052840 6/2005

(Continued)

OTHER PUBLICATIONS

International Search Report for PCT/KR2015/006895 dated Oct. 23, 2015 and its English translation from WIPO.

(Continued)

*Primary Examiner* — Sean Michalski
(74) *Attorney, Agent, or Firm* — Ladas & Parry LLP

(57) ABSTRACT

Disclosed is a punching apparatus, for a coil bound notebook, which divides into many an object to be bound such as a notebook, a book, an album and the like, then punches same while sequentially moving same and enables easy feeding of the object to be bound, for which the punching has been completed, to a subsequent coil binding position. A punching apparatus for a coil bound notebook, according to the present invention, has first and second alignment plates which are provided on a table on which an object to be coil bound is placed, a punch for punching into the object to be bound binding holes into which a coil spring is inserted, and a moving means for the object to be bound for moving the object to be bound to and from the punch. The moving means for the object to be bound comprises: a main body having a lower plate which is mounted on a support, a vertical plate which is fixed on the lower plate, and an upper plate which is fixed on the vertical plate so as to have the central part open; an LM guide having a rail which is fixed on the main body and a block which is coupled to the rail;

(Continued)

a saddle which is fixed on the block of the LM guide and has a plurality of step layers formed on one side; a plurality of unit moving units which have formed thereon clips, dividing the object to be bound and holding single sheet bundles, to become sequentially higher and each of which is mounted on each of the step layers of the saddle; and a saddle moving unit which has a supporting plate fixed on the saddle, a first cylinder of which an operating shaft is fixed on the supporting plate, a fixing plate for fixing the rear of the first cylinder, and a screw rod for screw coupling one side of the fixing plate, coupling a handle to the front end and rotatably mounted on frontal and rear supporting plates fixed on the main body.

4 Claims, 12 Drawing Sheets

(51) Int. Cl.
*B42B 5/12* (2006.01)
*B65H 5/16* (2006.01)

(56) References Cited

U.S. PATENT DOCUMENTS 5,163,008 A * 11/1992 Gerber ..... B26D 7/015 226/27
5,325,752 A * 7/1994 Bory ..... B26D 1/045 83/468.4
5,392,677 A * 2/1995 Sevart ..... B26D 1/08 83/468.3
5,628,502 A * 5/1997 Amarakoon ..... B26D 7/015 270/58.07
6,361,036 B1 * 3/2002 Nakazawa ..... B26D 7/015 270/52.17
6,601,490 B1 * 8/2003 Gross ..... B26D 7/015 83/27
6,684,744 B2 * 2/2004 Suzuki ..... B26D 7/14 264/156
6,688,199 B2 * 2/2004 Godston ..... B26D 5/10 83/167
6,702,330 B2 * 3/2004 Roca ..... B42B 5/08 281/15.1
7,047,855 B2 * 5/2006 Beccari ..... B26D 7/015 83/227
7,413,179 B2 * 8/2008 Honmochi ..... B26D 1/08 270/37
7,735,824 B2 * 6/2010 Frank ..... B26D 5/12 271/182
8,011,281 B2 * 9/2011 Hidaka ..... B26D 5/34 399/407
8,056,898 B2 * 11/2011 Folsom ..... B65H 5/16 270/52.16
8,266,784 B2 * 9/2012 Wu ..... B23P 19/04 29/24.5
9,302,404 B2 * 4/2016 Matsushima ..... B26D 5/005

FOREIGN PATENT DOCUMENTS

KR 10-0587221 6/2006
KR 10-0636254 10/2006
KR 10-0748993 8/2007
KR 10-1277870 6/2013
KR 20-0471557 3/2014

OTHER PUBLICATIONS

Written Opinion of the International Searching Authority for PCT/KR2015/006895 dated Oct. 23, 2015 and its English translation by Google Translate.

* cited by examiner (A)

(B)

PUNCHING APPARATUS FOR WIRE-BINDING BOOK

CROSS-REFERENCE TO RELATED APPLICATIONS

This application is the U.S. National Stage of International Patent Application No. PCT/KR2015/006895 filed on Jul. 3, 2015, which claims the priority to Korean Patent Application No. 10-2014-0086110 filed on Jul. 9, 2014, the disclosures of which are hereby incorporated in their entireties by reference.

TECHNICAL FIELD

Embodiments of the present invention may relate generally to a punching device punching coupling holes for spring binding in an object for binding, more particularly, a punching apparatus for a wire-binding book dividing the object for binding of a note, a book, an album and so on into a plurality and sequentially moving and punching them, and easily supplying the object for binding to a next wire-binding location after punching operation is completed.

BACKGROUND

Generally, as shown in FIGS. 7 (A) and (B), objects for binding (1), such as a note, a book, an album and so on, may have production thicknesses different from each other depending on the insides thereof, and for binding them during the process for transferring the printed cover or inserts coupling holes (110) may be automatically punched or after they are sorted according to print contents and punching the coupling holes (110), they may be combined into the unit object for binding (100) and the combined unit object for binding (100) may be bound by inserting a wire or spring (200) through the punched coupling holes (110). The binding of the wire (200) may be implemented by a one ring type method inserting a spiral steel wire into one end of the coupling holes (110) punched in the object for binding (100) and rotating it (See FIG. 7(A)) or a twin type method inserting loops having a "C" shape and formed by bending a steel wire into the coupling holes (110) punched in the object for binding (100) in upward and downward directions to be interlocked with each other (See FIG. 7(B)).

For example, the punching device for note binding holes of Korean Registered Utility Model No. 20-0303044 (registered on Feb. 6, 2003) which was filed by the present applicant and registered discloses an apparatus moving and punching sheets and then collecting them. Additionally, the method and apparatus for automatically binding a calendar of Korean Patent Application Publication No. 10-2005-0052840 (published on Jun. 7, 2005) discloses an apparatus combining 7-15 sheets to make a sheet unit and punching the sheet unit. Further, the punching device having a binder function of Korean Patent No. 10-0748993 (registered on Aug. 13, 2007) discloses an apparatus adding the binder function to a punching device so that one punching device can continuously perform punching operation as well as binding function binding with a spring.

The apparatuses described above need the process matching the punched coupling holes for wire binding when a sheet or a bunch of sheets is combined into a unit object for binding after coupling holes for binding are punched in the sheet or the bunch of sheets, and therefore the process is very inconvenient.

Further, the binding device of Korean Patent No. 10-0587221 (registered on Jun. 8, 2006) is an apparatus forming two lines so as to have three punching pins or two punching pins within one inch, and this device can bind with a spring after punch regardless of the size of paper, the gap between the punched holes and so on, but since this device has a structure that cannot punch the unit object for binding at once, after performing punching operations several times the additional procedure for combining and matching the punched coupling holes is also needed for spring binding and therefore it is inconvenient.

Accordingly, the necessity for a punching machine which can continuously perform wire binding processes in the status that the coupling holes are aligned after holding and moving a unit object binding instead of a sheet or a bunch of sheet and punching coupling holes is needed.

DETAILED DESCRIPTION OF THE INVENTION

Technical Problem

Therefore, the embodiments of the present application may solve the problems of prior art described above, and the purpose of the embodiments of the present invention may be for providing a punching apparatus for a wire-binding book which is capable of stably supplying an object for binding to a next wire binding position after easily dividing the object for binding such as a note, a book, an album and so on having various thicknesses into a plurality of sheet units, holding and sequentially moving them and finishing punching operations.

Technical Solution

To achieve the purpose, a punching apparatus for a wire-binding book according to an embodiment of the present invention may comprise a table arranged at an upper portion of a supporting plate, wherein an object for wire binding can be placed on the table, first and second alignment plates arranged at a center portion of the table and configured to be rotatable or movable upward and/or downward, a punching device mounted to a back portion of the table and comprising a punch pin punching a coupling hole in an object for binding into which a wire is inserted, a binding object transferring unit moving the object for binding to the punching device and returning the object for binding, the binding object transferring unit comprising: a main body comprising a lower portion plate mounted on a supporting plate, a vertical plate coupled to both sides of the lower portion plate and a upper portion plate configured to be open at a center thereof and fixed to an upper portion of the vertical plate; a first LM guide comprising a rail fixed to an upper side of the lower portion plate of the main body, and a block slidably coupled to the rail; a saddle fixed on the block of the first LM guide and continuously forming a plurality of stair layers in a side thereof from a lower portion to a upper portion; a plurality of unit transferring units dividing the object for binding placed on the table, arranging positions of clips holding sheet units higher in order and mounted to each of the stair layers; and a saddle transferring unit comprising a supporting plate fixed to a back portion of the saddle, a first cylinder fixing a front portion of a operation axis to the supporting plate, a fixing plate fixing a back portion of the first cylinder, and a screw pole which is screw-coupled to one side of the fixing plate, wherein the screw pole's front portion is coupled with a handle to move a portion of the fixing plate, the screw pole rotatably mounted to front and back supporting plates fixed to the lower portion plate or the vertical plate of the main body.

An embodiment of the present invention may comprise a third LM guide configured to move the main body left and right so that the holding position can be easily adjusted depending on the size of the object for binding and a guide plate having embossed grooves mounted to both sides of the upper portion plate the main body and the embossed grooves are movable left and/or right in the status coupled with embossed grooves corresponding to the table.

Effects of the Invention

The embodiments of the present invention may have the effect of preventing damage to punch pins of a punch device and extending the life span of the apparatus since even objects for binding having various thicknesses are divided into sheet units, the divided sheet units are held and sequentially moved to the punching device and then coupling holes are punched by the punch pins, and the operation efficiency may be improved and management and maintenance may be easy as after the punching hole operation of the coupling holes are completed the object for binding is returned and the object for binding may be returned and easily moved to the next process which is a wire binding position.

Further, although the size of the object for binding is variously changed, the clip position of a unit transferring unit is easily moved by a third LM guide and the stable separating position may be selected, and because embossed grooves of a guide plate and embossed grooves of a table are corresponded and interlocked to each other, the fall while placing the object for binding on the table may be prevented and therefore the operation efficiency may be improved.

BEST MODE FOR CARRYING OUT THE INVENTION

Figure 1:
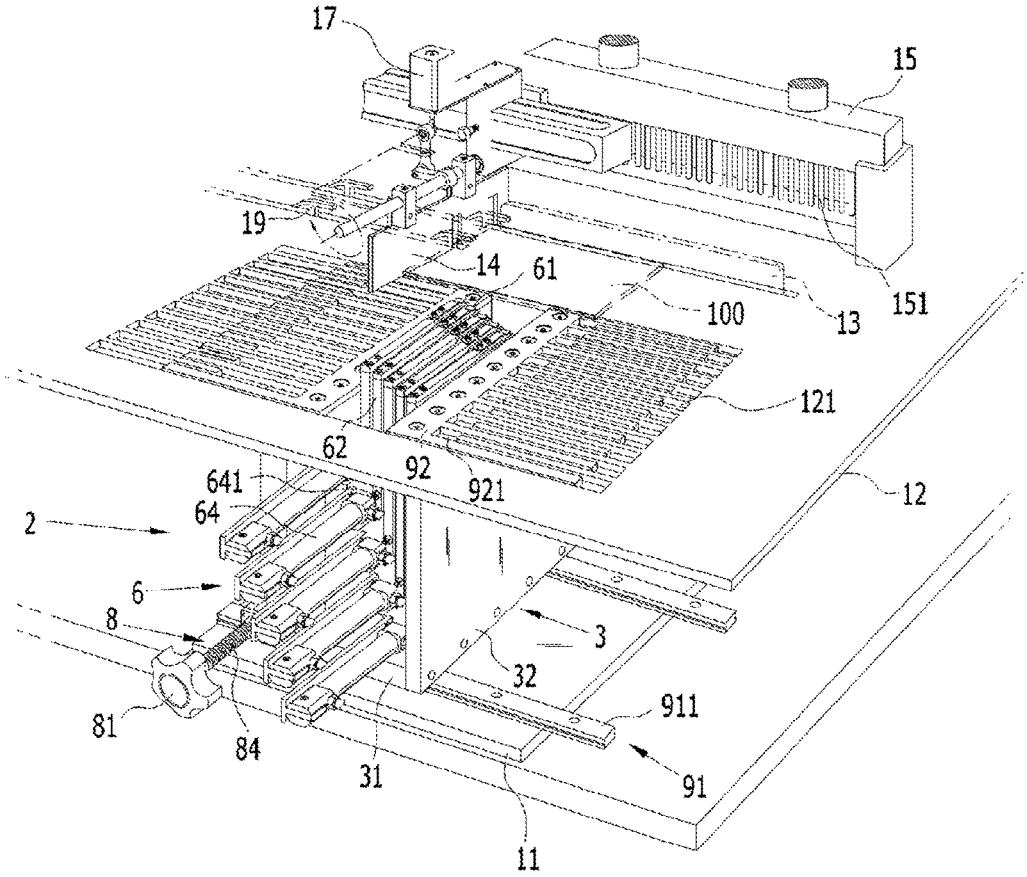
FIG. 1 is a perspective view illustrating a punching apparatus for a wire-binding book according to embodiments of the present invention.

A punching apparatus for a wire-binding book according to an embodiment of the present invention may comprise a table arranged at an upper portion of a supporting plate, wherein an object for wire binding can be placed on the table, first and second alignment plates arranged at a center portion of the table and configured to be rotatable or movable upward and/or downward, a punching device mounted to a back portion of the table and comprising a punch pin punching a coupling hole in an object for binding into which a wire is inserted, a binding object transferring unit moving the object for binding to the punching device and returning the object for binding, the binding object transferring unit comprising: a main body comprising a lower portion plate mounted on a supporting plate, a vertical plate coupled to both sides of the lower portion plate and a upper portion plate configured to be open at a center thereof and fixed to an upper portion of the vertical plate; a first LM guide comprising a rail fixed to an upper side of the lower portion plate of the main body, and a block slidably coupled to the rail; a saddle fixed on the block of the first LM guide and continuously forming a plurality of stair layers in a side thereof from a lower portion to a upper portion; a plurality of unit transferring units dividing the object for binding placed on the table, arranging positions of clips holding sheet units higher in order and mounted to each of the stair layers; and a saddle transferring unit comprising a supporting plate fixed to a back portion of the saddle, a first cylinder fixing a front portion of a operation axis to the supporting plate, a fixing plate fixing a back portion of the first cylinder, and a screw pole which is screw-coupled to one side of the fixing plate, wherein the screw pole's front portion is coupled with a handle to move a portion of the fixing plate, the screw pole rotatably mounted to front and back supporting plates fixed to the lower portion plate or the vertical plate of the main body.

According to an embodiment of the present invention, the unit transferring units may comprise the clips comprising a resilient part at a upper portion thereof and a coupling part at a lower portion thereof to stably hold the divided and held sheet units of the object of binding, supporting parts fixing the clips to an upper portion thereof, a second LM guide comprising a block fixed to a lower portion of the supporting parts and rails slidably coupling the block and mounted to each of the stair layers of the saddle, and a second cylinder fixing a operation axis to the supporting parts and fixing a back portion thereof to each of the stair layers of the saddle, wherein the supporting parts are mounted to each of positions from a lower stair layer to a highest stair layer and arrange the positions of the clips higher in order.

According to an embodiment of the present invention, a third LM guide may comprise a rail fixed to an upper portion of the supporting plate, and a block fixed to the rail, fixing the lower portion plate of the main body and configured to move the main body left and/or right; a guide plate comprising embossed grooves mounted to both sides of the upper portion plate of the main body; and embossed grooves correspondingly coupled to the embossed grooves, configured to be movable left and/or right, and formed at the table.

According to an embodiment of the present invention, a coupling groove may be formed at the clip, a hinge wound in a circle at a back portion of a resilient part may be formed to form a rotation center by being coupled to the coupling groove, and a spring may provide elastic force so that a front portion of the resilient part can move upward and downward and be returned and is positioned between a fixing bolt and a nut coupled to the fixing bolt.

Embodiments for Carrying Out the Invention

Hereinafter, preferred embodiments of the present invention will be described in detail with reference to the accompanied drawings.

Figure 2:
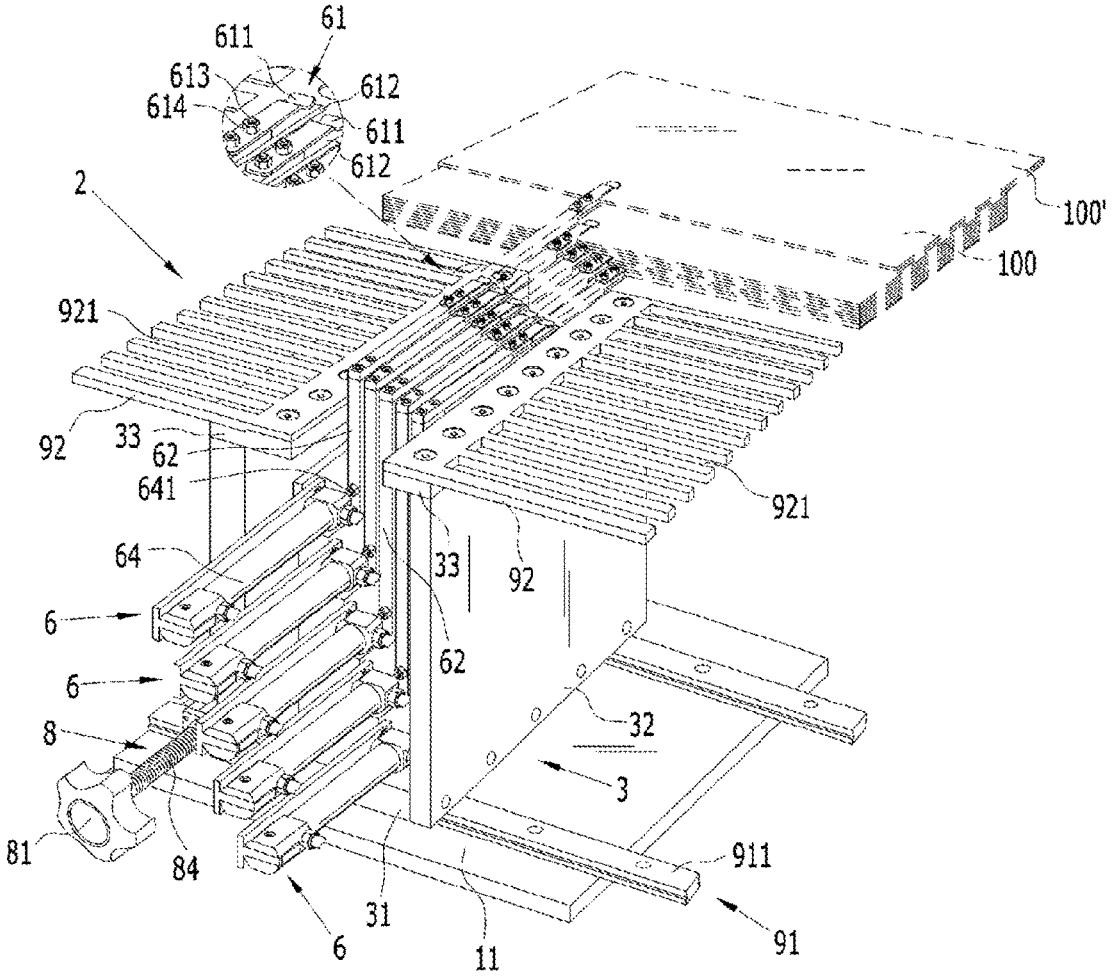
FIG. 2 is a perspective view illustrating a binding object transferring unit of a punching apparatus for a wire-binding book according to embodiments of the present invention.
Figure 3:
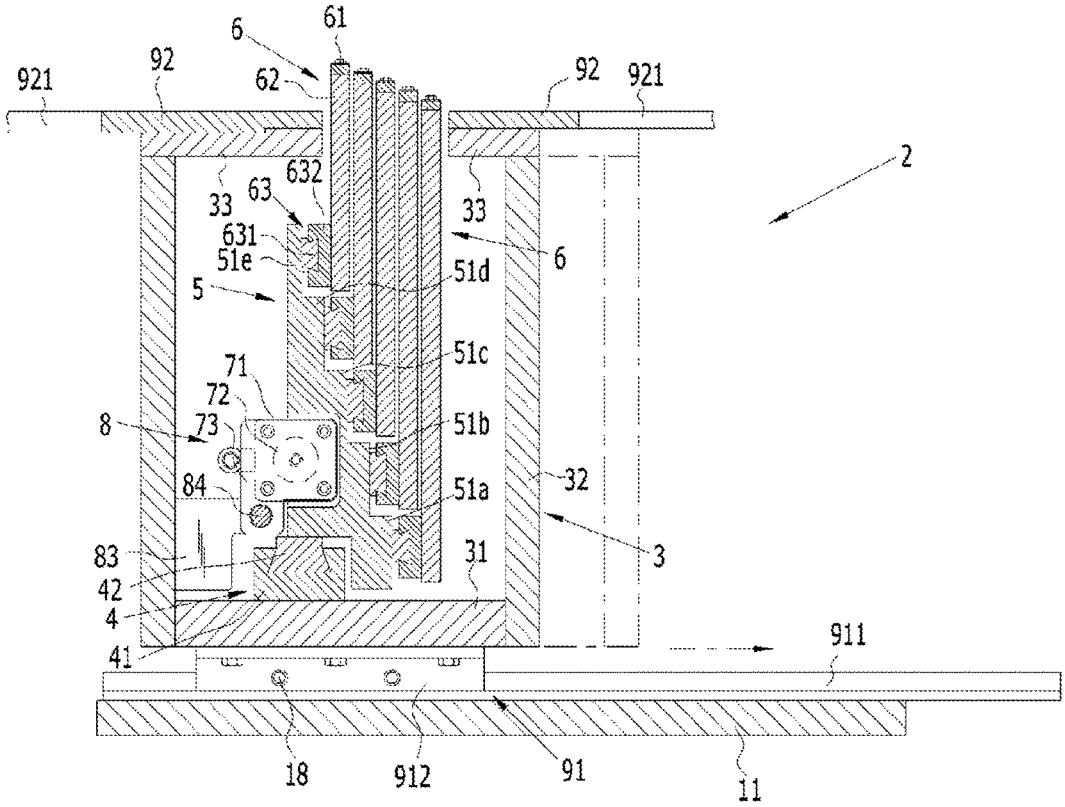
FIG. 3 is a longitudinal section illustrating a binding object transferring unit of a punching apparatus for a wire-binding book according to embodiments of the present invention.
Figure 7:
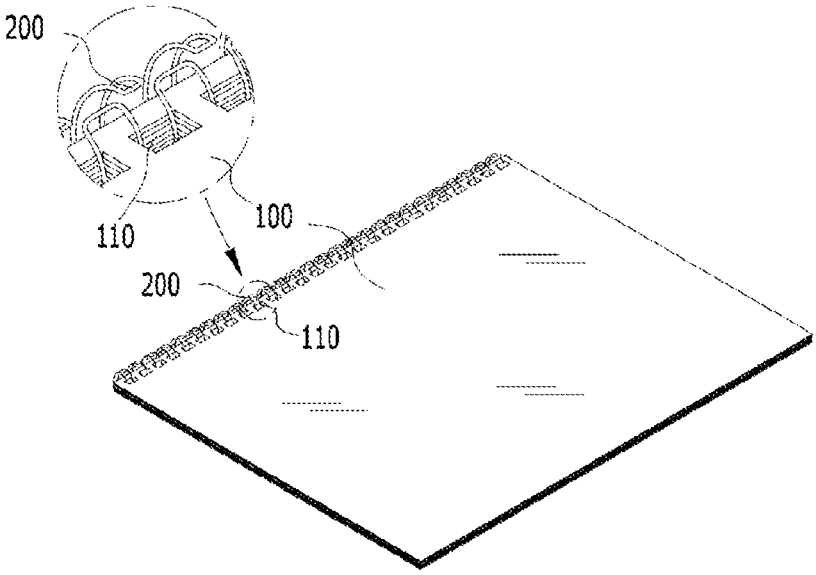
FIG. 7 is a perspective view illustrating an object for binding bound with a wire.
Figure 7:
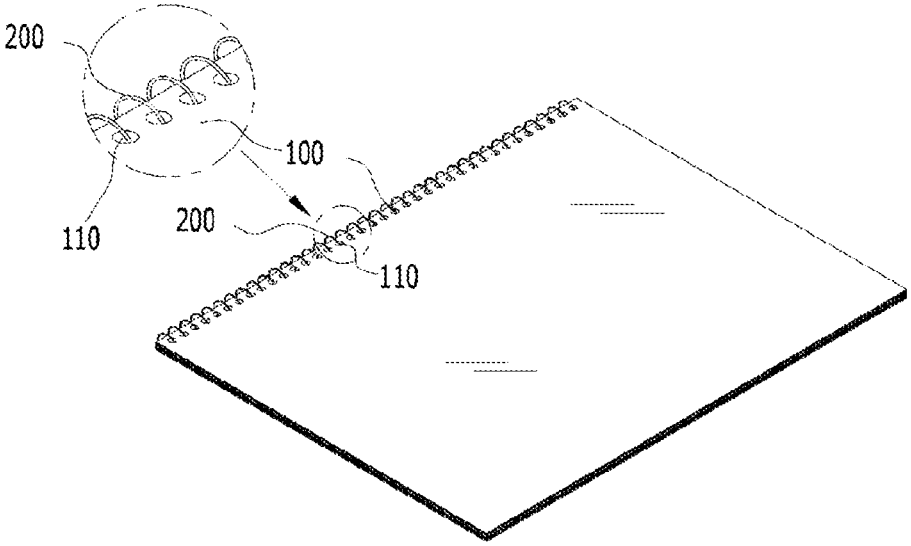

FIGS. 1 to 3 are perspective views and a longitudinal section illustrating a punching apparatus for a wire-binding book according to the present embodiment, and FIG. 7 is a perspective view illustrating a status that a wire is bound to an object for binding. As shown in the drawings, the punching apparatus for the wire-binding book according to the present embodiment of the present invention may comprise a binding object transferring unit (2) which may, to punch binding holes (110) to be bound by a wire or spring (200), divide an object for binding (100) consisting of a bunch of papers including a cover and inserts into sheet units (100') and hold them, move each of the sheet units (100') in order and punch the binding holes (110) in each of the sheet units (100'), and then align the sheet units (100') to be stably transferred to a next wire (200) binding location.

The binding object transferring unit (2) may, as shown in FIG. 1, comprise a main body (3), a first LM guide (4), a saddle (5), a unit transferring unit (6), and a saddle transferring unit (8) and be arranged at the upper portion of a supporting plate (11) to perform operations contacting the object for binding (100) to first and second alignment plates (13, 14) rotating or moving the object for binding (100) upward and downward, dividing the object for binding (100) into the sheet units (100'), sequentially moving each of the divided sheet units (100') to a punching device (15) and punching binding holes (110) by a punch pin (151), and returning the object for binding (100) to stably move to a next wire (200) binding position.

The main body (3) may comprise a lower portion plate (31) mounted to be movable on the supporting plate (11), a vertical plate (32) fixed to both sides of the lower portion plate (32) and an upper plate (33) of which center portion is openly fixed to the upper portion of the vertical plate (32).

The first LM guide (4) may comprise a rail (42) fixed to the upper side of the lower portion plate of the main body (3) and a block (42) slidably connected to the rail (42), and may perform a guiding operation to move the saddle (5), installed to the block (42), forward and backward.

The saddle (5) may be positioned on and fixed to the block (42) of the first LM guide (4) and form a plurality of stair layers (51*a* to 5*e*), continuously formed from bottom to top, on one side thereof, and each of the unit transferring units (6) may be fixed to the vertical portion of the stair layers (51*a* to 5*e*).

Each of the unit transferring units (6) may be mounted to each of the stair layers (51*a* to 5*e*) of the saddle (5) so that the positions of clips (61) may be arranged to be higher sequentially to divide paper of an object for binding (100) positioned on a table (12) into 20 to 30 sheets and hold each of the sheet units (100'). Additionally, the unit transferring unit (6) is not limited to be installed to the vertical portions of the stair layers (51*a* to 5*e*) and may be installed to horizontal portions thereof.

Figure 4A:
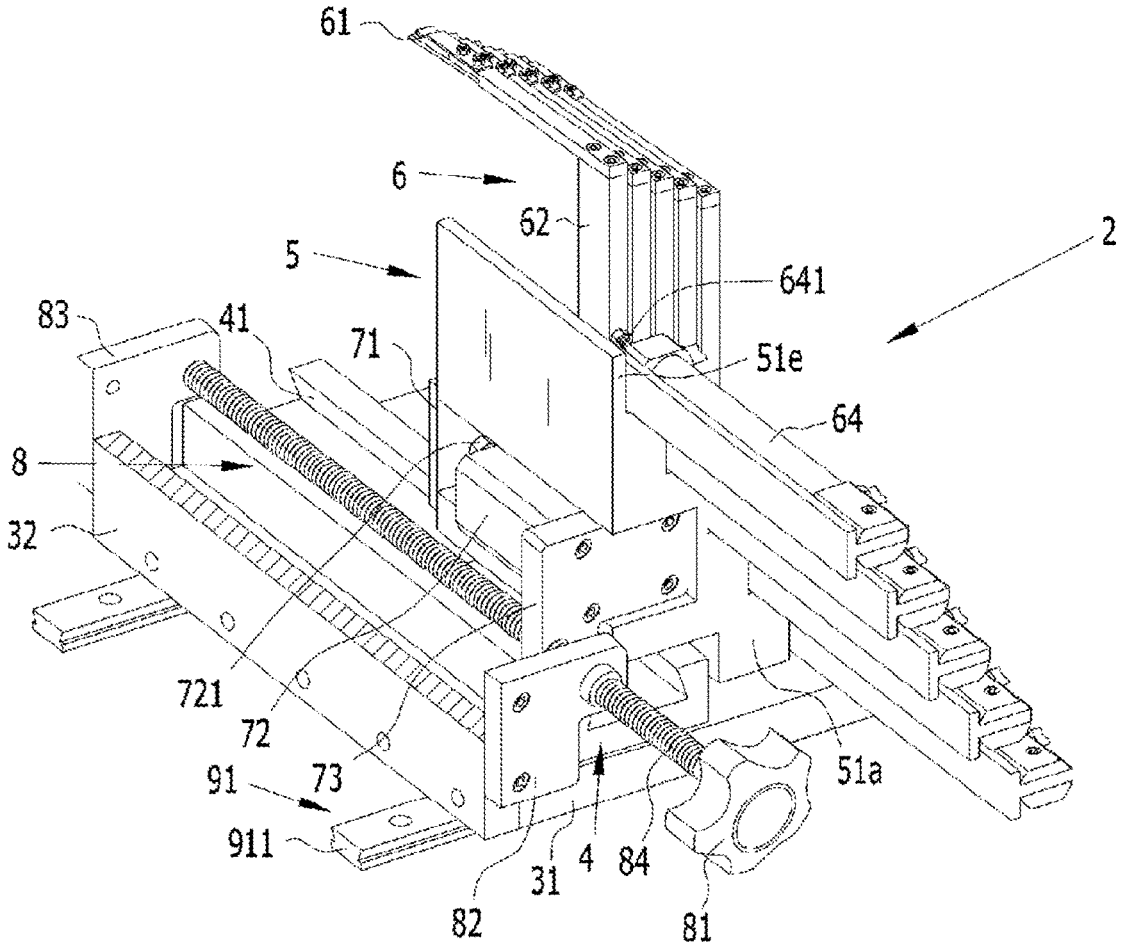
FIG. 4*a* to FIG. 4*d* are partial cross-sectional perspective views illustrating operation statuses of each step of a binding object transferring unit of a punching apparatus for a wire-binding book according to embodiments of the present invention.
Figure 4B:
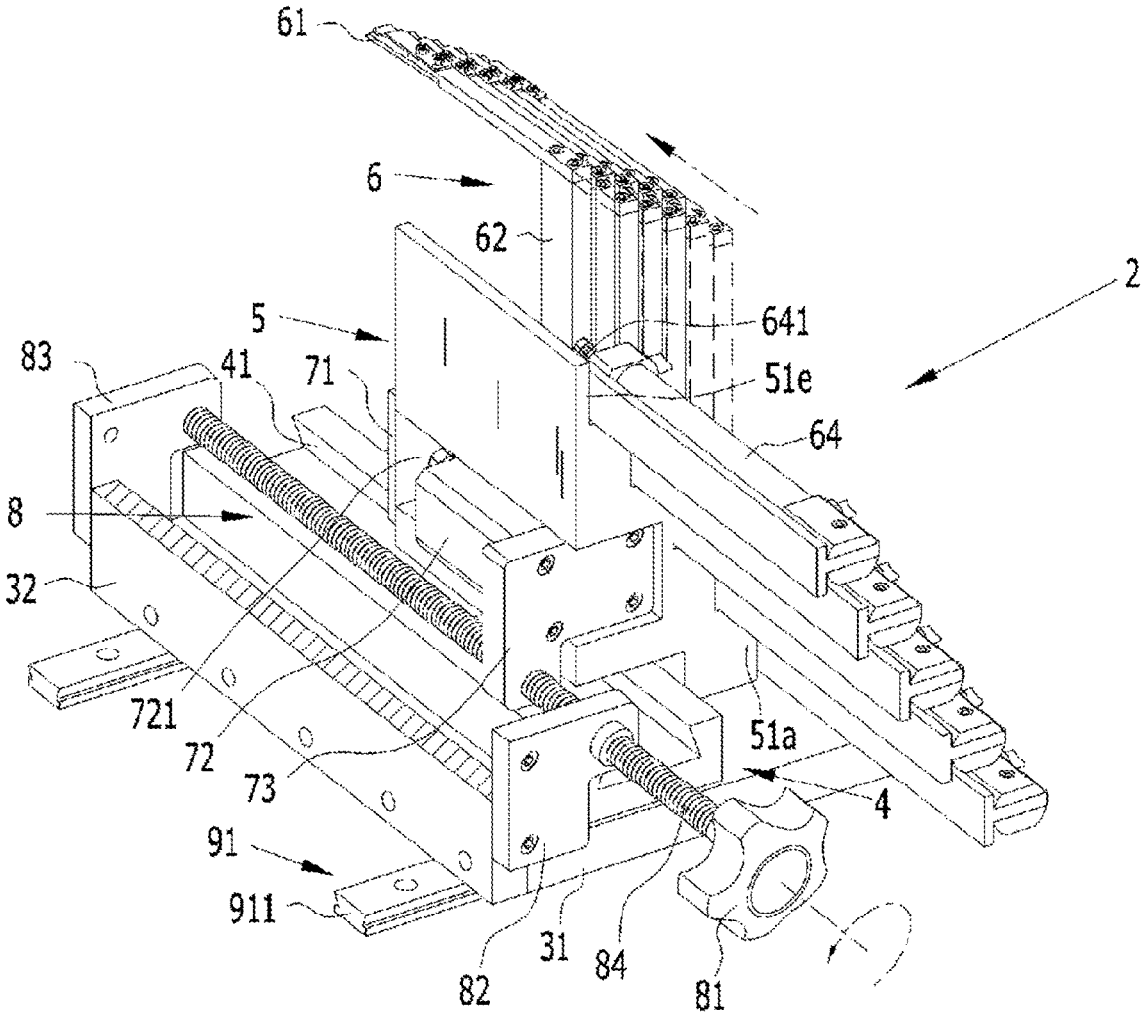
Figure 4C:
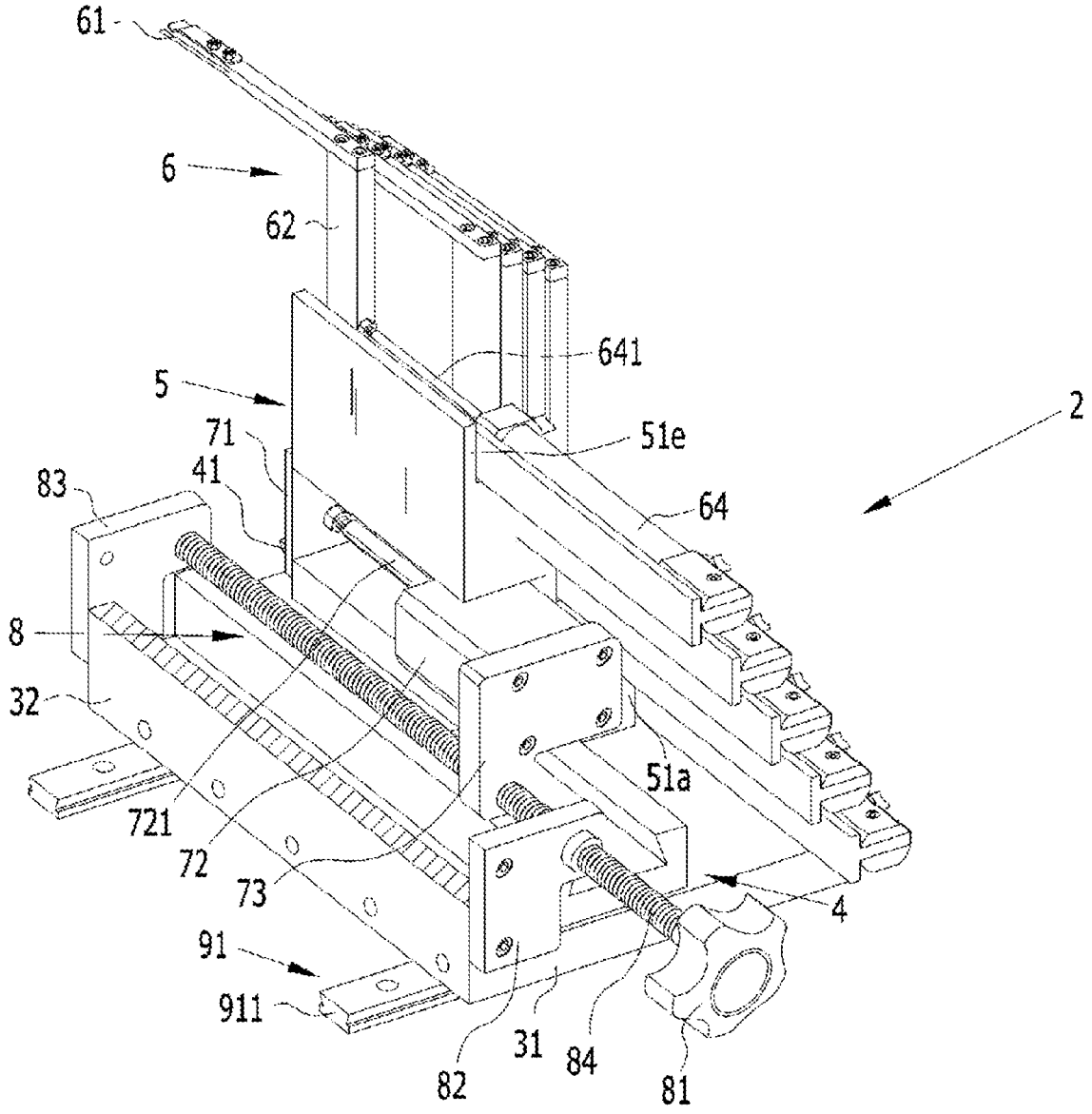

Further, detail configuration of the unit transferring unit (6) is shown in FIGS. 2, 3 and 4*c*, and the unit transferring unit (6) may comprise the clips (61) fixed by a fixing bolt (613) and a nut (613) to stably hold the divided and held sheet unit (100') and comprising an upper portion having a resilient portion (611) providing pressure and a lower portion having a coupling portion (612) providing a supporting operation, support parts (62) fixing the clips (61) to upper portions thereof and of which vertical lengths become longer in order so that the positions of the clips (61) are arranged to become higher sequentially to divide the object for binding (100) and hold the sheet units (100'), a block (631) fixed to the lower portion of the support part (62), a second LM guide (63) comprising a rail (632) to which the block (631) is slidably coupled and which is mounted to the stair layers (51*a* to 5*e*), and a second cylinder (64) fixing a operation axis (641) to the support part (62) and of which back portion is fixed to each of the stair layers (51*a* to 5*e*) of the saddle (5).

In addition, the unit transferring unit (6) is not limited to be mounted to each of 5 stairs of the stair layers (51*a* to 5*e*) of the saddle (5), and when the thickness of the object for binding (100) becomes thicker, it can be increased.

Accordingly, the present embodiment of the present invention may divide the object of binding (10) into sheet units (100') having 20 to 30 sheets, move them, and then punch the binding holes (110) by the punch pin (151) to prevent damage to the punching device (15) and extend lifespan.

The saddle transferring unit (8) may perform operation moving the saddle (5) itself forward and backward mounting the plurality of the unit moving units (6) and holding the sheet units (100') of the object for binding (100) or releasing the held status after punching the coupling holes (110) in the sheet unit (100'), and may comprise a supporting plate (71) fixed to a back portion of the saddle (5), a first cylinder (72) fixing a front portion of the operation axis (721) to the supporting plate (71), a supporting plate (73) fixing a back portion of the first cylinder (72), a screw pole (84) which is screw-coupled to one side of the fixing plate (73) and of which front portion is coupled with a handle (81) to move the position of the fixing plate (73), the screw pole (84) rotatably mounted to a front and back supporting plates (82, 83) fixed to the lower portion plate (31) or the vertical plate (32) of the main body (3).

Additionally, as shown in FIG. 1, the position of the clip (61) of the unit transferring unit (6) holding the object for binding (100) may be preferred to be located adjacent to the center portion of the object for binding (100), and therefore, the position of the clip (61) of the unit transferring unit (6) may be variously changed according to change of the size of the object for binding (100). To solve this, a third LM guide (91) moving the main body (3) of the binding object transferring unit (2) itself may be comprised, and embossed grooves (921) and embossed grooves (121) corresponding to and coupled to the upper portion plate (33) of the main body (3) and the table (12), respectively, may be formed. Therefore, the third LM guide (91) may comprise a rail (911) fixed to the upper portion of the supporting plate (11), and a block (912) coupled to the rail (911) and fixing the lower portion plate (31) of the main body (3), and configured to move left and right the main body (3). Further, the embossed grooves (921) may be formed in the guide plate (92) mounted to both sides of the upper portion plate (33) of the main body (31), and the embossed grooves (121) may be formed in the table (12) to correspond to the embossed grooves (921) of the guide plate (92) and may allow the guide plate (92) to move left and right.

Figure 6:
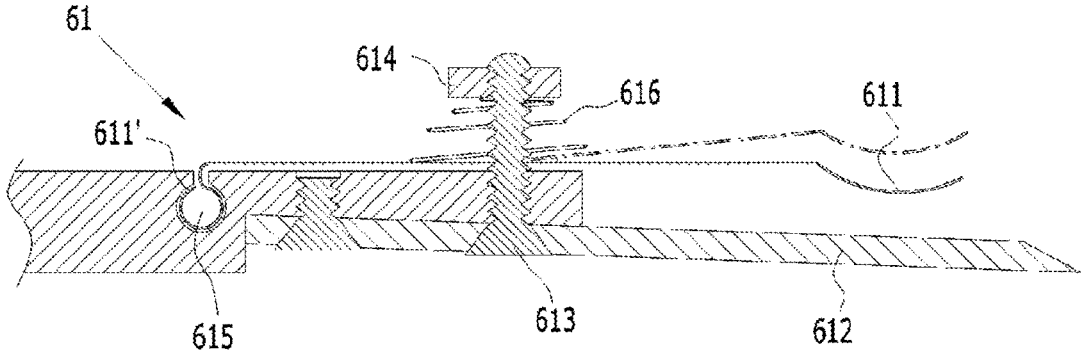
FIG. 6 is a partial cross-sectional view illustrating a clip according to a punching apparatus for a wire-binding book of another embodiment of the present invention.

In addition, according to another embodiment of the clip (61), as shown in FIG. 6, the coupling groove (615) may be formed in the clip (61) and the back portion of the resilient part (611) may be inserted to the coupling groove (651) and form the hinge (611') wound in a circle to form a rotation center so that the front portion of the resilient part (611) may be moved upward and downward and the object for binding (100) may be inserted when holding the object for binding (100), the upper portion of a spring (616) providing elastic force that can move upward and downward and return the front portion of the resilient part (611) may be coupled to a nut (614) coupled to the fixing bolt (613) and the lower portion thereof may be contact the resilient part (611).

Among elements in the drawings not described above, the element 16 may be a third cylinder configured to move a first alignment plate (13) upward and downward, the element 17 may be a fourth cylinder configure to rotate a second alignment plate (14), the element 18 may be a stop bolt configured to stop movement of the block (222), the element 19 may be tongs for transferring which transfer the object for binding (100), which was punched and the coupling holes (110) were formed in, to a next process for binding it with the wire (200).

Further, the first to fourth cylinders (72, 64, 16, 17) may be devices for maintaining operation and stop statuses by using air or oil pressure by a control device not shown, and detail description for structures and operation is omitted since it is well known in the art.

Next, operation of the punching apparatus for the wire-binding book described above according to an embodiment of the present invention will be described.

First, to precisely hold the object for binding (100) by the clip (16) mounted to the upper portion of the unit transferring unit (6) of the binding object transferring unit (2) or to set the position for returning to an initial status after operation, in the status illustrated in FIG. 4*a*, when the handle (81) is rotated as shown in FIG. 4*b*, the screw pole (84) may be rotated and the fixing plate (73) may be moved. In this time, the first cylinder (72) fixed to the fixing plate (73), the operation axis (721) of the first cylinder (72), the supporting plate (71) fixed to the front portion of the operation axis (721) and the saddle (5) fixed to the supporting plate (71) may be moved. Additionally, the saddle (5) may be smoothly moved by the first LM guide (4).

Figure 5A:
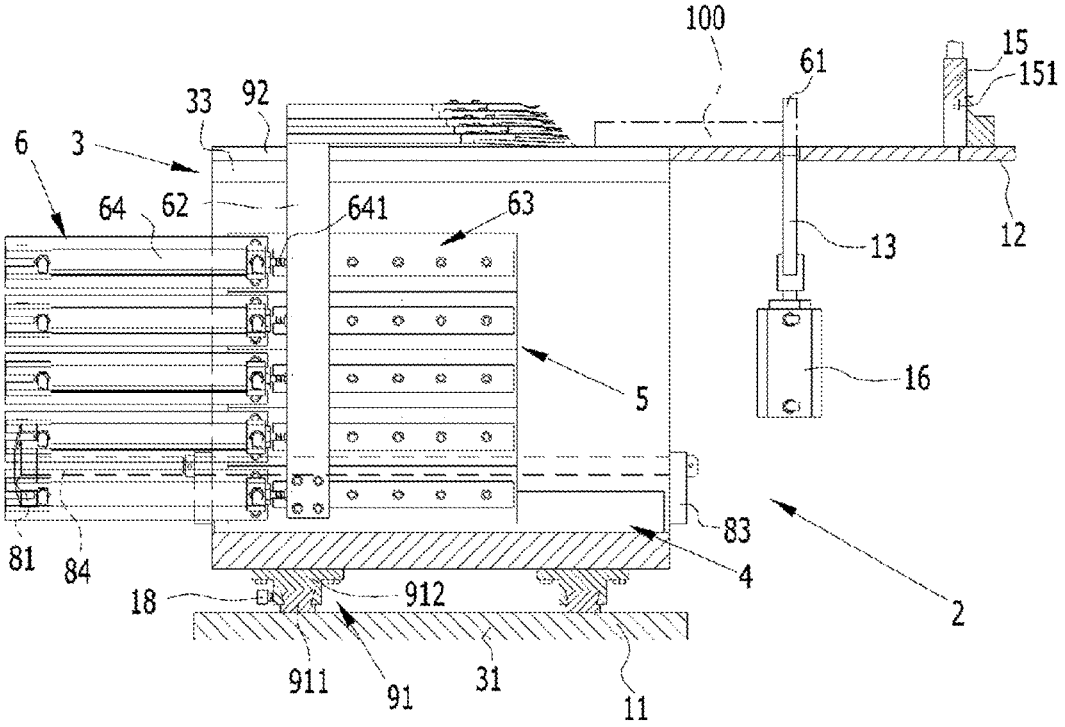
FIG. 5*a* to FIG. 5*d* are partial cross-sectional side views illustrating operation statuses of each step for separating, holding and punching an object for binding according to a binding object transferring unit of a punching apparatus for a wire-binding book of embodiments of the present invention.

Additionally, as shown in FIG. 4*b* and FIG. 5*a*, the position of the clip (61) mounted to the upper portion of the unit transferring unit (6) may be set on a preferred position, and then the object for binding (100) may be placed on the table (12) and may contact the first alignment plate (13) and the second alignment plate (14) with edge portions thereof for correct alignment.

Figure 5B:
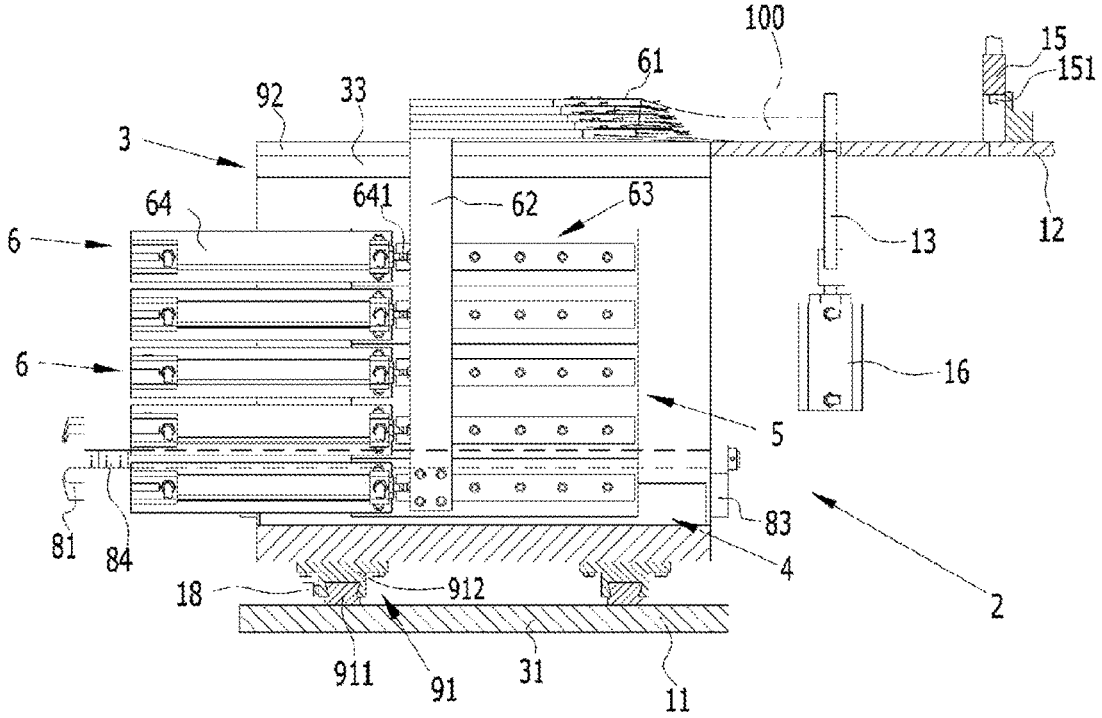

Next, when the operation axis (721) moves the saddle (5), fixed to the supporting plate (71), forward by operation of the first cylinder (72), the plurality of the unit transferring units (6) mounted to the saddle (5) may move together and, as shown in FIG. 4*c* and FIG. 5*b*, contact the object for binding (100), and at the same time the plurality of the clips (61) may divide the object for binding (100) and hold the sheet units (100'). In this time, the clip (61) of the unit transferring unit (6) mounted to the lowest stair layer (51*a*) of the saddle (6) may be inserted into a portion located at a lower portion of the object for binding (100) first and the sheet unit (100') may be held, and then each of the clips (61) of the unit transferring units (6) mounted to the next stair layer (51*b*) to highest stair layer (51*e*), which are moved and contacted one after another, may divide and hold the sheet units (100') of the object for binding (100) in order.

Accordingly, the order for dividing the object for binding (100) and holding the sheet units (100') may be continued from the clip (61) of the unit transferring unit (6) mounted to the lowest stair layer (51*a*) of the saddle (5) to the clip (61) of the unit transferring unit (6) mounted to the highest stair layer (51*e*) of the saddle (5) when the saddle (5) is moved forward by operation of the first cylinder (72) and, when the holding operation of the sheet units (100') is finished, the operation of the first cylinder (72) may be stopped and the stop status may be maintained.

Figure 4D:
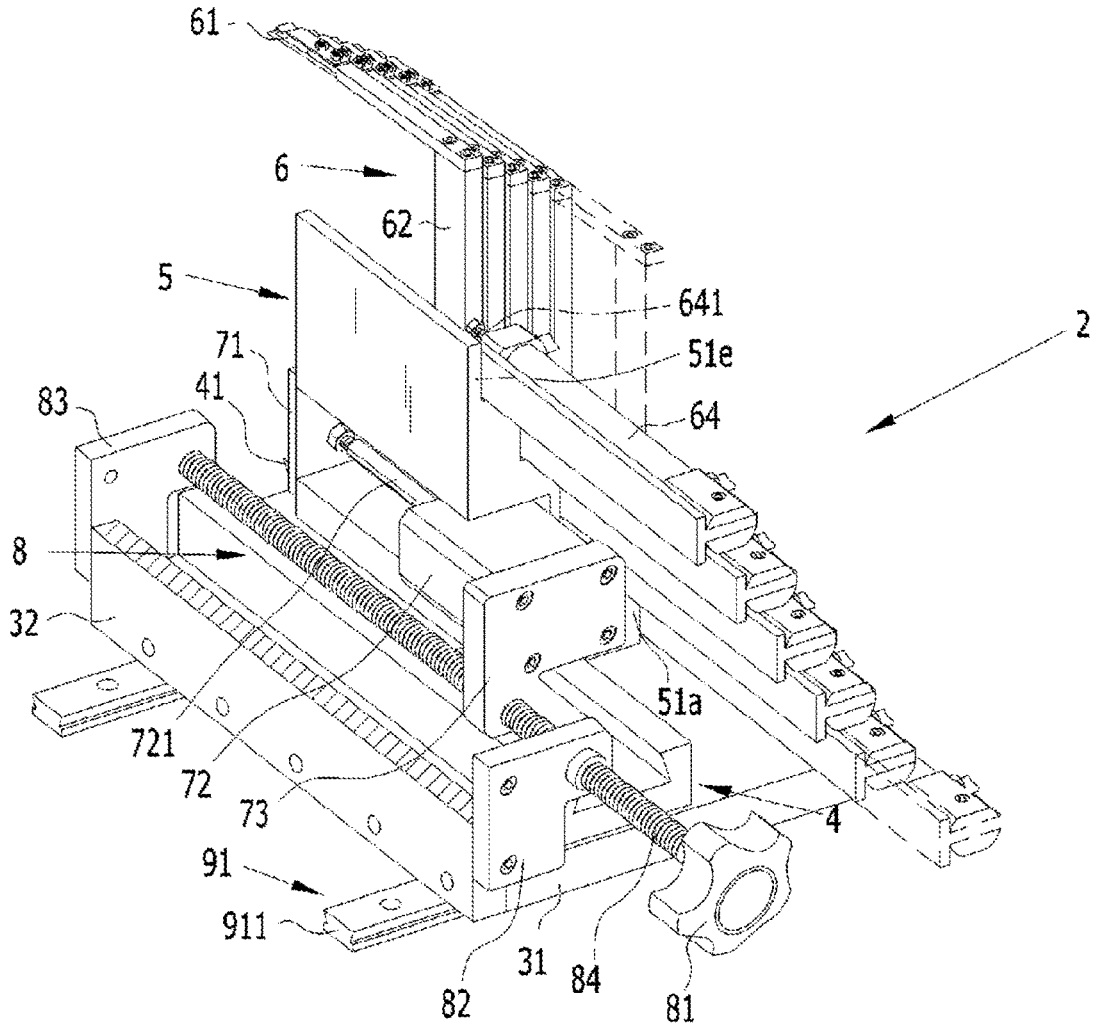
Figure 5C:
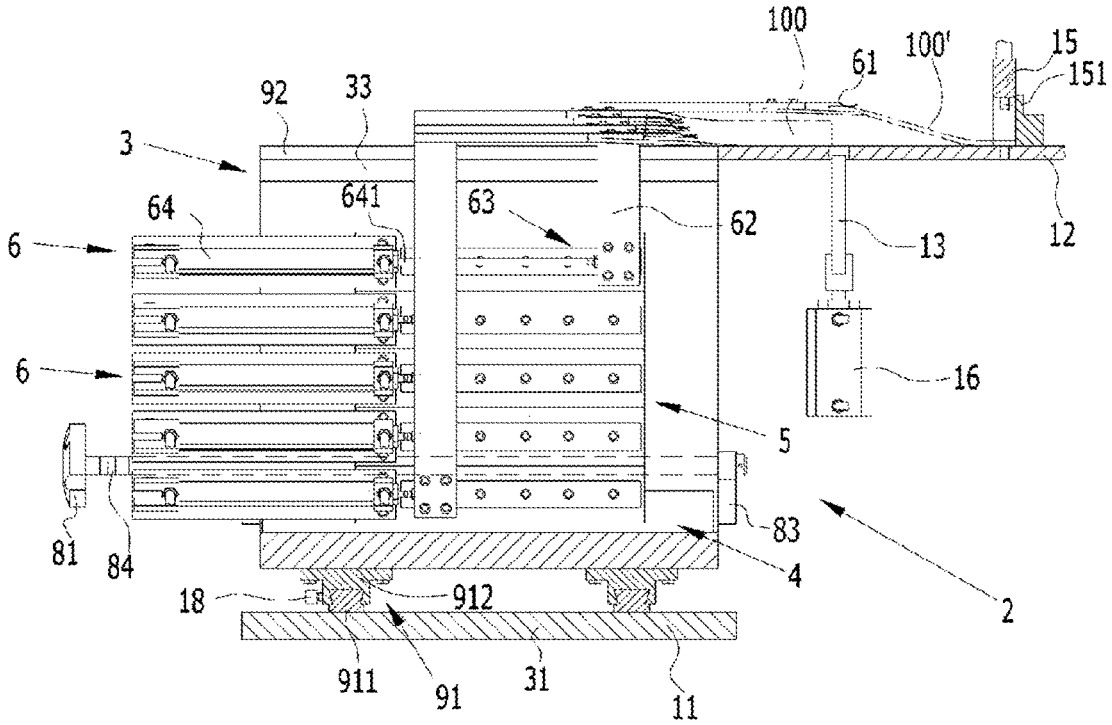

Next, the shut off status may be released so that the sheet unit (100') of the object for binding (100) divided by moving the first alignment plate (13) downward toward the lower portion of the table (12) by the operation of the third cylinder (16) can be moved to the punching device (15), and then by operating the second cylinder (64) of the unit transferring unit (6) mounted to the highest stair layer (51*e*), the sheet unit (100') of the object for binding (100), which is divided and held as shown in FIG. 4*c* and FIG. 5*c*, may be moved toward the punching device (15) and be stopped, and then by lowering the punch pin (151) of the punching device (15) the sheet unit (100') of the object for binding (100) may be punched to punch the coupling holes (100) and the status is continuously maintained. Next, the sheet unit (100') of the object for binding (100) divided by sequentially operating the second cylinders (64) of the unit transferring unit (6) mounted from the next stair layer (51*d*) to the lowest stair layer (51*a*) may be moved toward the punching device (15) and may be stopped at the status being inserted into the lower surface of the sheet unit (100') previously processed, and then when the process of the coupling holes (110) is finished by punch of the punch pin (151), there may be the object for binding (100) consisted of all stacked sheet units (100') as shown in FIGS. 4*d* and 5*d*.

Figure 5D:
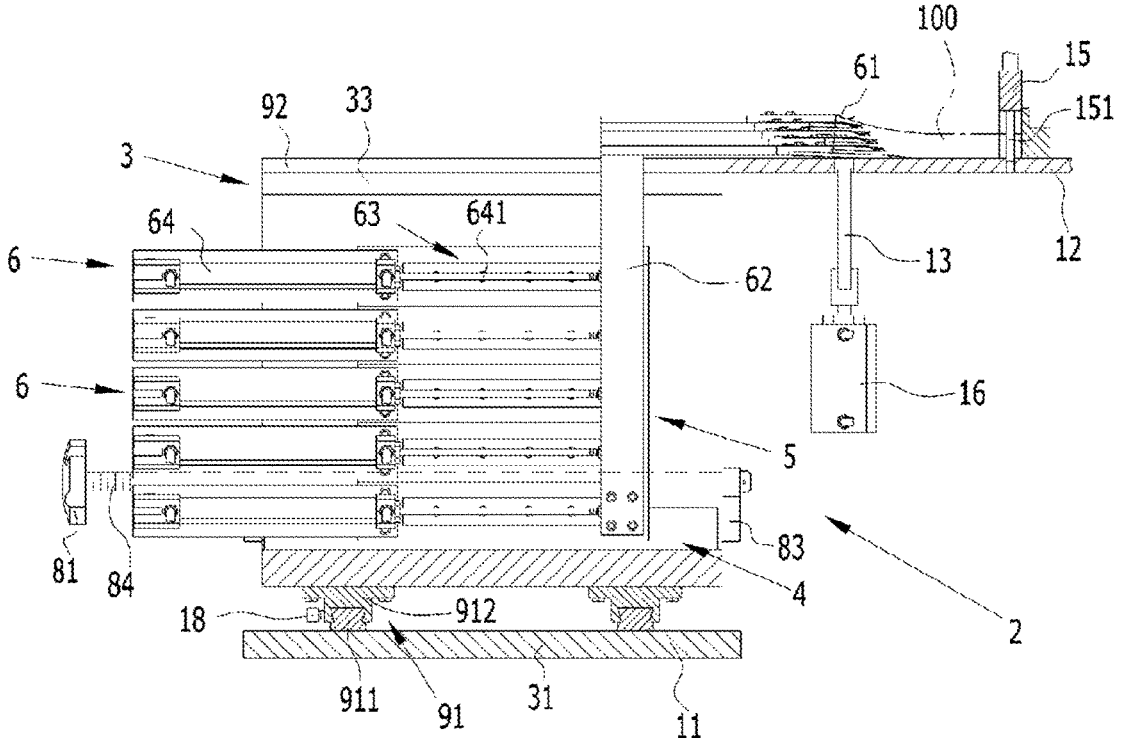

Next, in the status of FIG. 5*d* where all coupling holes (110) were punched in the unit object for binding (100), all second cylinders (64) of the unit transferring unit (6) mounted to each of the stair layers (51*a* to 5*e*) of the saddle (5) may be return to an original status simultaneously, and the object for binding (100) held to the each of the clips (61) may be moved to the status of FIG. 5*b* and then stopped. Then, to move the object for binding (100) to the wire (200) binding location which is a next process, as shown in FIG. 1, in the status holding the object for binding (100) by tongs the operation axis (721) of the first cylinder (72) may be returned. In this time, as the entire saddle (5) may be returned and the clip (61) of the unit transferring unit (100) holding the object for binding (100) may be naturally separated, and therefore when, a cycle operation returning to an original standby position such as FIG. 5*a* may be completed.

Accordingly, in the embodiments of the present application, even an object for binding (100) having various thicknesses may easily aligned by the first and second alignment plates (16, 17), and by moving the saddle (5) forward the object for binding (100) may be divided into sheet units (100') and held by the clips (61), then at the same time as lowering the first alignment plate (16) the sheet units (100') may be sequentially moved toward the punching device (15) by operation of the second cylinder (64) of the unit transferring unit (6) and then all of the coupling holes (110) may be punched by the punch pin (151), then after returning all of the second cylinders (64) of the unit transferring unit (6), in the stopped status, the object for binding (100) may be held by tongs for transfer (19), then to transfer the object for binding (100) to the binding location the saddle (5) may be returned by operation of the first cylinder (72) and the clip (61) holding the sheet unit (100') may be separated from the object for binding (100), then to operate movement of the object for binding (100) held by the tongs for transfer (19) the second alignment plate (14) may be rotated by operation of the fourth cylinder (17) and the shut down status may be released to provide a moving passage, and therefore an operation process for punching the coupling holes (110) of the unit object for binding (100) and coupling the wire (200) may be efficiently performed and the productivity may be improved.

Further, even if the size of the object for binding (100) is changed, the position of the clip (61) of the unit transferring unit (6) may be moved left and right by the third LM guide (91) and the object for binding (100) may be divided and easily held in a stable position, and since the embossed grooves (921) of the guide plate (92) and the embossed grooves (121) of the table (12) may be interlockedly connected to correspondingly moved, the object for binding (100) may be prevented from being fallen until it is placed on the table (12) and therefore it may provide the effect of increasing operation efficiency.

Additionally, as shown in FIG. 6, as the front portion of the resilient part (611) of the clip (61) may be smoothly open and restored by a spring (616) providing elastic force and arranged at the center, it may be freely inserted into the object for binding (100) and easily picked, and therefore the efficiency for clip operation for punch may be improved.

The forgoing disclosure explains and illustrates preferred embodiments of the present invention, but it is not intended to be limited to the configuration and operation illustrated and explained. Accordingly, as a person having ordinary skill in the art can easily understand that the embodiments can be properly changed and modified, proper modification and variations and its equivalents are within the scope of the present invention.

What is claimed is:

1. A punching apparatus for a wire-binding book comprising a table arranged at an upper portion of a supporting plate, wherein an object for wire binding can be placed on the table, first and second alignment plates arranged at a center portion of the table and configured to be rotatable or movable upward and/or downward, a punching device mounted to a back portion of the table and comprising a punch pin punching a coupling hole in an object for binding into which a wire is inserted, a binding object transferring unit moving the object for binding to the punching device and returning the object for binding, the binding object transferring unit comprising:

a main body comprising
- a lower portion plate mounted on a supporting plate,
- a vertical plate coupled to both sides of the lower portion plate and
- a upper portion plate configured to be open at a center thereof and fixed to an upper portion of the vertical plate;

a first LM guide comprising
- a rail fixed to an upper side of the lower portion plate of the main body, and
- a block slidably coupled to the rail;

a saddle fixed on the block of the first LM guide and continuously forming a plurality of stair layers in a side thereof from a lower portion to a upper portion;

a plurality of unit transferring units dividing the object for binding placed on the table, arranging positions of clips holding sheet units higher in order and mounted to each of the stair layers; and a saddle transferring unit comprising
- a supporting plate fixed to a back portion of the saddle,
- a first cylinder fixing a front portion of a operation axis to the supporting plate,
- a fixing plate fixing a back portion of the first cylinder, and
- a screw pole which is screw-coupled to one side of the fixing plate, wherein the screw pole's front portion is coupled with a handle to move a portion of the fixing plate, the screw pole rotatably mounted to front and back supporting plates fixed to the lower portion plate or the vertical plate of the main body.

2. The punching apparatus for the wire-binding book of claim 1, wherein the unit transferring units comprise:

the clips comprising a resilient part at a upper portion thereof and a coupling part at a lower portion thereof to stably hold the divided and held sheet units of the object of binding, supporting parts fixing the clips to an upper portion thereof, a second LM guide comprising a block fixed to a lower portion of the supporting parts and rails slidably coupling the block and mounted to each of the stair layers of the saddle, and a second cylinder fixing a operation axis to the supporting parts and fixing a back portion thereof to each of the stair layers of the saddle, wherein the supporting parts are mounted to each of positions from a lower stair layer to a highest stair layer and arrange the positions of the clips higher in order.

3. The punching apparatus for the wire-binding book of claim 1, comprising:

a third LM guide comprising
- a rail fixed to an upper portion of the supporting plate, and
- a block fixed to the rail, fixing the lower portion plate of the main body and configured to move the main body left and/or right;

a guide plate comprising embossed grooves mounted to both sides of the upper portion plate of the main body; and embossed grooves correspondingly coupled to the embossed grooves, configured to be movable left and/or right, and formed at the table.

4. The punching apparatus for the wire-binding book of claim 1, wherein a coupling groove is formed at the clip, a hinge wound in a circle at a back portion of a resilient part is formed to form a rotation center by being coupled to the coupling groove, and a spring provides elastic force so that a front portion of the resilient part can move upward and downward and be returned and is positioned between a fixing bolt and a nut coupled to the fixing bolt.

* * * * *